US008635877B2

(12) United States Patent
Kim et al.

(10) Patent No.: US 8,635,877 B2
(45) Date of Patent: Jan. 28, 2014

(54) ICE DETECTING APPARATUS OF ICE MAKER FOR REFRIGERATOR AND ICE DETECTING METHOD THEREOF

(75) Inventors: Yong-Su Kim, Seoul (KR); Dong-Hoon Lee, Seoul (KR); Kyung-Han Jeong, Seoul (KR); Kwang-Ha Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 1085 days.

(21) Appl. No.: 12/433,944

(22) Filed: May 1, 2009

(65) Prior Publication Data

US 2009/0272130 A1 Nov. 5, 2009

(30) Foreign Application Priority Data

May 1, 2008 (KR) ..... 10-2008-0041084

(51) Int. Cl.
*F25C 5/18* (2006.01)
*F25C 1/00* (2006.01)
*F25C 5/00* (2006.01)

(52) U.S. Cl.
USPC ..... 62/137; 62/344; 62/377

(58) Field of Classification Search
USPC ..... 62/137, 344, 377
See application file for complete search history.

(56) References Cited

U.S. PATENT DOCUMENTS

| | | | | |
|---|---|---|---|---|
| 3,860,169 A | | 1/1975 | Norman | 236/68 |
| 4,044,348 A | | 8/1977 | Huebscher | 340/227.1 |
| 4,201,910 A | | 5/1980 | Copeland et al. | 250/216 |
| 4,237,366 A | | 12/1980 | Berg | 219/219 |
| 4,756,165 A | | 7/1988 | Chestnut et al. | 62/135 |
| 5,013,911 A | | 5/1991 | Koshida et al. | |
| 5,060,484 A | * | 10/1991 | Bush et al. | 62/137 |
| 5,160,094 A | | 11/1992 | Willis et al. | 62/137 |
| 5,296,819 A | | 3/1994 | Kuroiwa et al. | 324/670 |
| 5,361,990 A | | 11/1994 | Pimentel | 239/133 |

(Continued)

FOREIGN PATENT DOCUMENTS

| | | |
|---|---|---|
| CN | 1435622 A | 8/2003 |
| CN | 2769791 Y | 4/2006 |

(Continued)

OTHER PUBLICATIONS

PCT International Search Report dated Nov. 6, 2009 for Application No. PCT/KR2009/001709.

(Continued)

*Primary Examiner* — Ljiljana Ciric
*Assistant Examiner* — Alexis Cox
(74) *Attorney, Agent, or Firm* — KED & Associates, LLP

(57) ABSTRACT

An ice detecting apparatus for a refrigerator having an ice maker includes an ice detecting sensor which determines whether or not an ice storage container which receives and stores ice made by the ice maker is full or nearly full of ice based on pulses transmitted from and received by transmitting and receiving units. The ice detecting sensor includes a transmitting unit to transmit one or more pulses and a receiving unit to detect the pulses transmitted from the transmitting unit. A controller is operably coupled to the transmitting and receiving units to determine whether the storage container is full or nearly full based on pulses detected by the receiving unit among one or more pulses transmitted by the transmitting unit. The controller also determines whether or not external light has been introduced into the ice maker based on the pulses detected by the receiving unit.

16 Claims, 20 Drawing Sheets

(56) References Cited

U.S. PATENT DOCUMENTS

| | | | | |
|---|---|---|---|---|
| 5,376,785 | A | 12/1994 | Chin et al. | 250/214 |
| 5,758,377 | A | 6/1998 | Cimetta et al. | |
| 6,050,097 | A | 4/2000 | Nelson et al. | 62/137 |
| 6,082,130 | A | 7/2000 | Pastryk et al. | 62/344 |
| 6,130,410 | A | 10/2000 | Kita | 219/270 |
| 6,148,624 | A | 11/2000 | Bishop et al. | 62/137 |
| 6,192,693 | B1 | 2/2001 | Kloppenberg et al. | 62/137 |
| 6,286,324 | B1 | 9/2001 | Pastryk et al. | 62/137 |
| 6,314,745 | B1 | 11/2001 | Janke et al. | 62/137 |
| 6,351,958 | B1 * | 3/2002 | Pastryk et al. | 62/137 |
| 6,705,091 | B1 | 3/2004 | Kim et al. | 62/74 |
| 6,857,279 | B2 | 2/2005 | Kim et al. | 62/135 |
| 7,017,354 | B2 | 3/2006 | Lee et al. | 62/73 |
| 7,080,518 | B2 | 7/2006 | Kim et al. | 62/73 |
| 7,210,299 | B2 | 5/2007 | Yang | 62/71 |
| 7,779,641 | B2 | 8/2010 | Lee et al. | 62/137 |
| 7,930,893 | B2 | 4/2011 | Coffey | |
| 8,156,748 | B2 * | 4/2012 | Ashrafzadeh et al. | 62/137 |
| 8,424,323 | B2 * | 4/2013 | Austin et al. | 62/137 |
| 2002/0047007 | A1 | 4/2002 | Loyd, Sr. et al. | 219/530 |
| 2002/0083726 | A1 | 7/2002 | Kim et al. | |
| 2005/0066670 | A1 | 3/2005 | Chung et al. | |
| 2005/0072167 | A1 | 4/2005 | Oh | |
| 2006/0168983 | A1 | 8/2006 | Tatsui et al. | |
| 2006/0213213 | A1 | 9/2006 | Chung et al. | 62/344 |
| 2006/0260347 | A1 | 11/2006 | Coulter et al. | 62/344 |
| 2007/0137241 | A1 | 6/2007 | Lee et al. | 62/340 |
| 2008/0156005 | A1 | 7/2008 | Culley et al. | 62/132 |
| 2008/0157644 | A1 | 7/2008 | Lee et al. | 312/405 |
| 2008/0264074 | A1 * | 10/2008 | Chase et al. | 62/66 |
| 2009/0100847 | A1 | 4/2009 | Moon et al. | 62/66 |
| 2009/0165471 | A1 | 7/2009 | Rafalovich et al. | 62/66 |
| 2009/0211292 | A1 | 8/2009 | Smith et al. | 62/344 |
| 2010/0204832 | A1 | 8/2010 | Choi et al. | 700/275 |

FOREIGN PATENT DOCUMENTS

| | | | |
|---|---|---|---|
| EP | 476738 | A1 * | 3/1992 |
| JP | 03-93379 | | 9/1991 |
| JP | 05-280848 | | 10/1993 |
| JP | 05-280848 | A | 10/1993 |
| JP | 2003-332027 | A | 11/2003 |
| KR | 10-2003-0021529 | A | 3/2003 |
| KR | 10-2003-00215129 | A | 3/2003 |
| KR | 10-2005-0033729 | A | 4/2005 |
| KR | 10-2008-0026385 | A | 3/2008 |
| WO | WO 2009/128614 | | 10/2009 |

OTHER PUBLICATIONS

PCT International Search Report dated Nov. 6, 2009 for Application No. PCT/KR2009/001863.
United States Office Action dated Jan. 18, 2012 issued in U.S. Appl. No. 12/423,170.
United States Office Action dated Jan. 19, 2012 issued in U.S. Appl. No. 12/423,256.
United States Office Action dated Apr. 13, 2012 issued in U.S. Appl. No. 12/471,048.
United States Office Action dated May 25, 2012 issued in U.S. Appl. No. 12/470,615.
United States Office Action dated Dec. 27, 2011 issued in U.S. Appl. No. 12/423,118.
United States Final Office Action dated Nov. 22, 2011 issued in U.S. Appl. No. 12/471,048.
Chinese Office Action dated Apr. 16, 2012 issued in Application No. 200980119669.X.
Office Action dated Apr. 14, 2011 issued in U.S. Appl. No. 12/471,078.
United States Final Office Action dated Nov. 20, 2012 issued in U.S. Appl. No. 12/471,048.
United States Office Action dated Dec. 20, 2012 issued in U.S. Appl. No. 12/423,118.
United States Office Action dated Jan. 7, 2013 issued in U.S. Appl. No. 12/423,256.
United States Office Action dated Jan. 11,2013 issued in U.S. Appl. No. 12/423,170.
United States Notice of Allowance dated Oct. 12, 2012 issued in U.S. Appl. No. 12/470,615.
Office Action issued in U.S. Appl. No. 12/471,048 dated Mar. 18, 2013.
Office Action issued in U.S. Appl. No. 12/423,170 dated May 30, 2013.
Office Action issued in U.S. Appl. No. 12/423,256 dated Jun. 10, 2013.
Hodgin, Michael J., et al.; "Advanced Boron Nitride Epoxy Formulations Excel in Thermal Management Applications"; Proceedings of the Technical Programs, NEPCON West 1999 Conference; Feb. 23-25, 1999; Anaheim, CA; pp. 359-366.
United States Final Office Action dated Jul. 24, 2012 issued in U.S. Appl. No. 12/423,118.
United States Final Office Action dated Aug. 28, 2012 issued in U.S. Appl. No. 12/423,170.
United States Final Office Action dated Sep. 4, 2012 issued in U.S. Appl. No. 12/423,256.
Australian Office Action issued in AU Application No. 2009340579 dated Nov. 28, 2012.
Final Office Action issued in U.S. Appl. No. 12/423,118 dated Oct. 2, 2013.
Office Action issued in U.S. Appl. No. 12/423,170 dated Nov. 27, 2013.
Office Action issued in U.S. Appl. No. 12/423,256 dated Nov. 27, 2013.
Notice of Allowance issued in U.S. Appl. No. 12/471,048 dated Aug. 30, 2013.
Office Action issued in U.S. Appl. No. 12/749,760 dated Jul. 23, 2013.

* cited by examiner

ICE DETECTING APPARATUS OF ICE MAKER FOR REFRIGERATOR AND ICE DETECTING METHOD THEREOF

BACKGROUND

1. Field

The patent disclosure relates to a refrigerator.

2. Background

A refrigerator refrigerates or freezes food items or the like to keep them fresh in storage. The refrigerator includes an ice maker for making ice and an ice container to receive ice made by the ice maker. A full ice detection lever, a mechanical device, coupled to a controller detects whether or not the ice container is full of ice. The full ice detection lever is positioned at a lower side and rises as high as the ice is accumulated in the ice container. When the full ice detection lever rises by more than a certain height due to ice accumulation, the controller determines that the ice container is full.

However, in the related art, if the full ice detection lever becomes frozen, the mechanical operation of the full ice detection lever is not likely to be performed, and the controller cannot determine whether the ice container is full. In such faulty state, ice is continuously supplied, causing an overflow of ice from the ice container.

SUMMARY OF THE DISCLOSURE

An ice detecting apparatus for a refrigerator comprising an ice maker, a storage container to collect ice from the ice maker, an ice detecting sensor provided at the ice maker including: an a transmitting unit to transmit one or more pulses and a receiving unit to detect the pulses transmitted from the transmitting unit. A controller to determines whether the storage container is full or nearly full based on the pulses detected by the receiving unit among one or more pulses transmitted by the transmitting unit.

BRIEF DESCRIPTION OF THE DRAWINGS

The embodiments will be described in detail with reference to the following drawings in which like reference numerals refer to like elements wherein.

DETAILED DESCRIPTION

Figure 1:
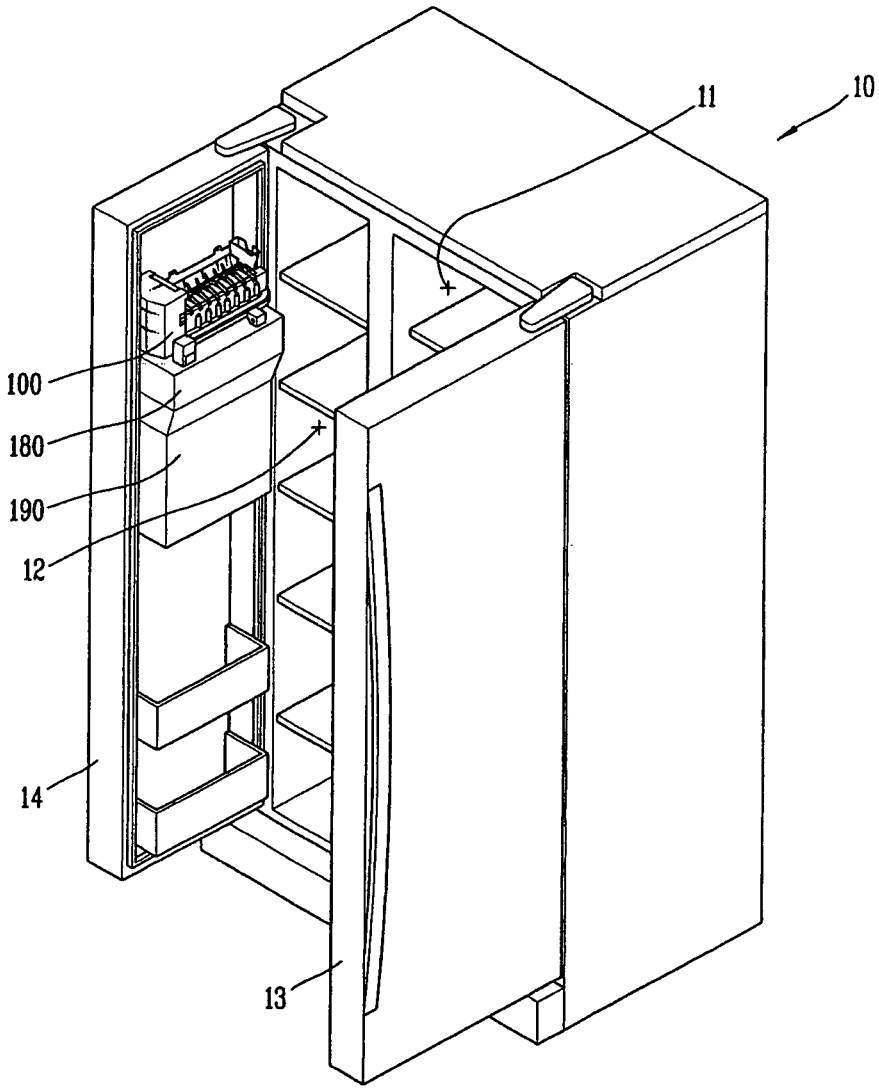
FIG. 1 is a front perspective view of a refrigerator employing an ice detecting apparatus of an ice maker according to a first embodiment.

FIG. 1 is a front perspective view of a refrigerator employing an ice-full state detecting apparatus of an ice maker according to a first embodiment. A refrigerator 10 includes a refrigerating chamber 11 for keeping food or storage items in storage in a cool state at an above-zero temperature, and a freezing chamber 12 for keeping food storage items such as ice at a near or below-zero temperature. An ice maker 100 is provided in the freezing chamber 12 and an ice storage container or storage bin 180 stores ice made by the ice maker 100.

A dispenser 190 supplies ice kept in the ice container 180 when user demands. One of ordinary skill in the art can appreciate that the refrigerator 10 includes various components such as a compressor, a condenser, an expander, an evaporator, and the like, to form a refrigerating cycle. The refrigerating chamber 11 and the freezing chamber 12 are accessed using a refrigerating chamber door 13 and a freezing chamber door 14, rotatably attached to the housing.

After a prescribed amount of water is supplied to the ice maker 100, ice is made by the supplied cooling air in the ice maker 100, and the ice is separated from the ice maker 100 according to a self-operation of the ice maker 100. The ice falls into the ice container 180 so as to be collected therein. The ice collected in the ice container 180 is supplied to the user by a desired amount through the dispenser 190. As can be appreciated, the ice maker 100 may be installed inside the freezing chamber 12 rather than on the door 14.

Figure 2:
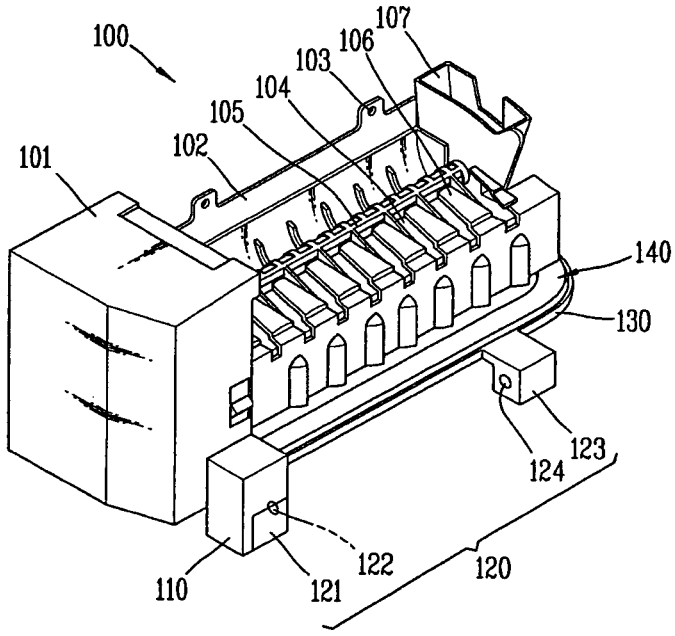
FIG. 2 is a perspective view of the ice maker for the refrigerator employing the ice detecting apparatus according to the first embodiment.
Figure 3:
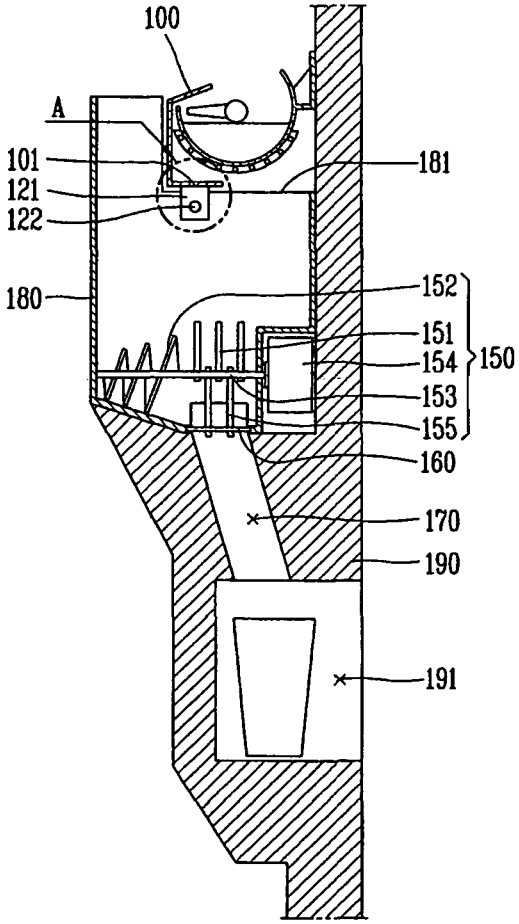
FIG. 3 is a vertical sectional view of the ice maker for the refrigerator employing the ice detecting apparatus according to the first embodiment.
Figure 4:
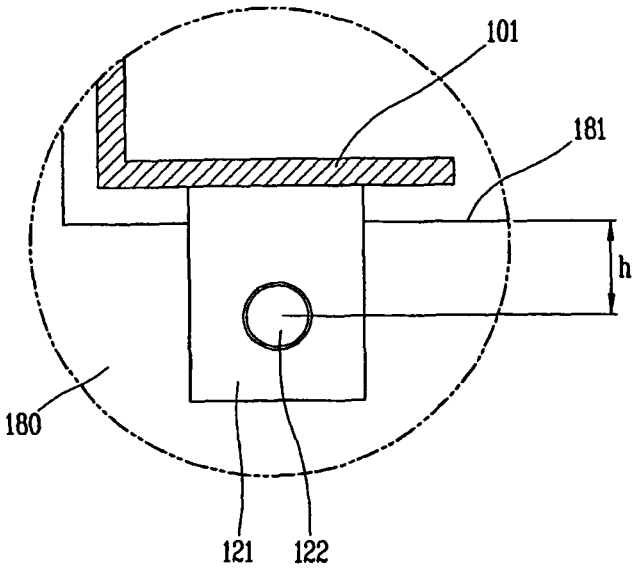
FIG. 4 is an enlarged view of a portion 'A' in FIG. 3.

FIG. 2 is a perspective view of the ice maker for the refrigerator employing the ice detecting apparatus according to the first embodiment. FIG. 3 is a vertical sectional view of the ice maker for the refrigerator employing the ice detecting apparatus according to the first embodiment, and FIG. 4 is an enlarged view of a portion 'A' in FIG. 3.

A water supply unit 107 of an ice maker 100 receives water provided from the exterior, and ice is made in an ice making chamber 104 of an ice maker 100. An ejector 105 of an ice maker 100 separates ice made in the ice making chamber 104, and an ice maker body 101 of an ice maker 100 includes a plurality of components for rotating the ejector 105. A rotational shaft extends out of the ice maker body 101. The ejector 105 has portions (or arms) extending outwardly (or radially) from the shaft and rotates according to a rotational movement of the shaft in order to pick up ice.

A mounting unit or plate 102 is formed behind the ice making chamber 104 to mount the ice maker 100 within the refrigerator. Holes 103, into which a combining protrusion is inserted, allow the mounting unit 102 to be mounted on the door or within the freezing chamber. A separator 106 is formed at an upper portion of the ice making chamber 104 to allow ice to be picked up by the ejector 105 to be guided and fall into the ice container 180.

A heater 140 is installed at a lower portion of the ice making chamber 104 in order to apply heat to allow the interfaces of ice and an inner surface of the ice making chamber 104 to be separated from each other. The heater 140 may be electrically connected to an external power source, which may be provided within the ice maker body 101.

A heater support 130 may be formed at a lower portion of the heater 140. The heater support 130 may be connected with the ice maker body 101, or the heater support 130 may be molded together with the ice maker body 101.

In this embodiment, a sensor housing 110 extends with a certain length in a downward direction from the ice maker body 101. A portion of the heater support 130 extends up to a position corresponding to the sensor housing 110.

A transmitting unit or module 121 is installed in the sensor housing 110, and a receiving unit or module 123 is installed at a portion extending from the heater support 130 to correspond to the sensor housing 110 or the transmitting unit 120. A transmitter 122 and a receiver 124 for transmitting and receiving signals are installed in the transmitting unit 121 and the receiving unit 123, respectively, to face each other. Based on the transmitting and received signals, the transmitting unit 121 and the receiving unit 123 are used to detect an ice-full state of the ice container 180. An ice detecting sensor 120 comprises at least one of the transmitter 122 and the receiver 124, transmitting and receiving units 121, 123, or sensor housing, and is used to determine or detect ice full state of the ice container 180.

The ice detecting sensor 120 may be disposed in or near the top, above or below the top of the ice container 180 at a position corresponding to the height at which ice is fully accumulated or collected. The transmitter and/or receiver may be optical devices to transmit or receive IR light. For example, the transmitter or emitter may be an IR photo diode and the receiver may be a photo transistor. The structure of the optical emitter or receiver is disclosed in U.S. Pat. No. 4,201,910, whose entire disclosure is incorporated herein by reference.

As shown in FIGS. 3 and 4, the transmitting unit 121 of the ice detecting sensor 120 extends in a downward direction down to the interior of the ice storage container 180. The transmitter 122 is installed or positioned at a lower portion of the transmitting unit 121. The transmitter is disposed at a position corresponding to the height of the ice-full state of the ice container 180. Although, the position of the transmitter 122 has been described, the receiving unit 123 and the receiver 124 may be formed to correspond to or near the height of the transmitting unit 121 and the transmitter 122, as can be appreciated by one of ordinary skill in the art. In this embodiment, a detection height of the ice detecting sensor 120 may have a certain height difference (h) from an upper end or top ridgeline 181 of the ice container 180.

The transmitting unit 121 and the receiving unit 123 of the ice detecting sensor 120 are located at both sides of an ice discharging outlet, a passage through which ice is discharged from the ice maker body 101. The receiver 124 receives infrared rays transmitted from the transmitter 122, traversing the ice discharging outlet, and provide corresponding signals for determining whether the ice container 180 is substantially full of ice to detect the ice-full state. As can be appreciated, the location of the transmitting module and the receiving module may be reversed, i.e., receiver on the left and emitter on the right.

In this embodiment, the transmitter module and the receiver module are separated by a prescribed distance which is less than a width of the storage bin. Such lesser distance to the width allows the modules to be placed within the storage bin. In an alternative embodiment, the distance may be greater than the width such that the modules may be located outside the storage bin.

A transfer unit 150 is installed at a lower portion of the ice container 180. The transfer unit 150 transfers ice stored in the ice container 180 (crushes the ice into an appropriate size, if desired) through an outlet 160 and a guide path 170 to a dispenser 190.

The transfer unit or assembly 150 includes a fixed blade 155 fixed in the ice container 180, a rotatable blade 151 relatively rotating with respect to the fixed blade 155, a rotational shaft 153 to which the rotational blade 151 is connected, a motor 154 connected to the rotational shaft 153, and a transfer blade 152 to allow the transfer of ice. The rotatable blade 151 is formed at one side of the rotational shaft 153, and the transfer blade 152 is formed at the other side of the rotational shaft. Thus, when the rotational shaft 153 is rotated, the rotational blade 151 and the transfer blade 152 can be rotated together. A spiral auger may be used as the transfer blade 152.

Water is guided by a water supply pipe of a certain shape so as to be supplied to the water supply unit 107. The supplied water is introduced into the ice making chamber 104, and below-zero or near zero cold air is provided in the ice making chamber to freeze water received in the ice making chamber 104. After the water within the ice making chamber 104 becomes frozen, heat is applied toward the ice making chamber 104 by the heater 140 to allow the ice and the contact surface of the ice making chamber 104 to be separated from each other.

The ejector 105 operates by a certain driving mechanism installed in the ice maker body 101 to pick up the ice. After the ice is picked up by the ejector 105, it is guided by the separator 106 and then falls into the ice container 180 for storage. This operation is repeated, and when the ice container 180 is near full or full of ice, the ice detecting sensor 120 detects the ice-full state, and the operation of the ice maker 100 is stopped.

When ice supply to the user via the dispenser 190 is requested, the motor 154 is driven and the rotational shaft 153 connected to the motor 154 is rotated. Then, the rotational blade 151 and the transfer blade 152 are rotated in conjunction. As the transfer blade 152 is rotated, ice in a lower portion of the ice container 180 is transferred toward the rotational blade 151. When the ice guided toward the rotational blade 151 is caught between the rotational blade 151 and the fixed blade 155, it is crushed according to a pushing operation of the rotational blade 151. The crushed ice is dispensed through the outlet 160 formed at a lower side of the fixed blade 155. The dispensed ice falls through the guide path 170. The fallen ice is then supplied to the user via the dispenser 190. As can be appreciated, various components described above are controlled by at least one controller provided in the ice maker and/or the refrigerator, including making a determination of a full-state based on at least one signal received from the receiver.

Various types of ice makers and operations thereof are disclosed in U.S. Pat. Nos. 7,210,299, 7,080,518, 7,017,354, 6,857,279, and 6,705,091, whose entire disclosures are incorporated herein by reference. These patents are also commonly assigned to the same assignee of this application.

Figure 5:
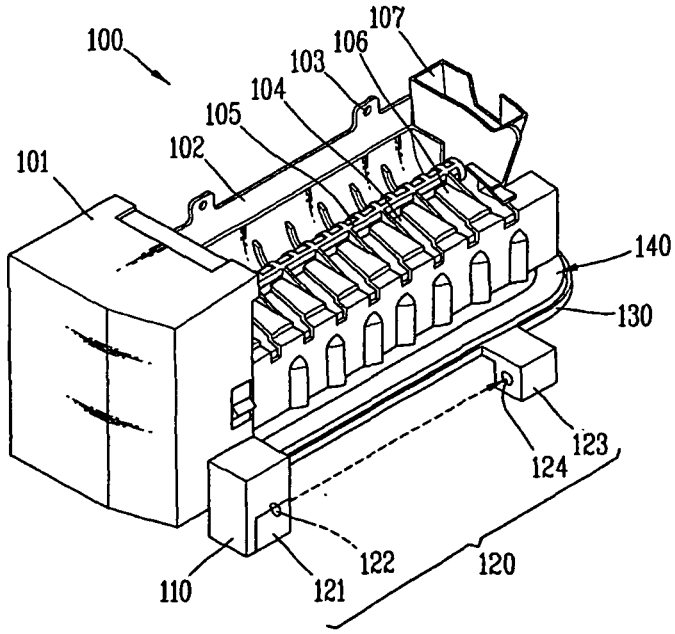
FIG. 5 is a perspective view showing that the ice detecting apparatus of the ice maker for the refrigerator detects a state before full ice according to the first embodiment.
Figure 6:
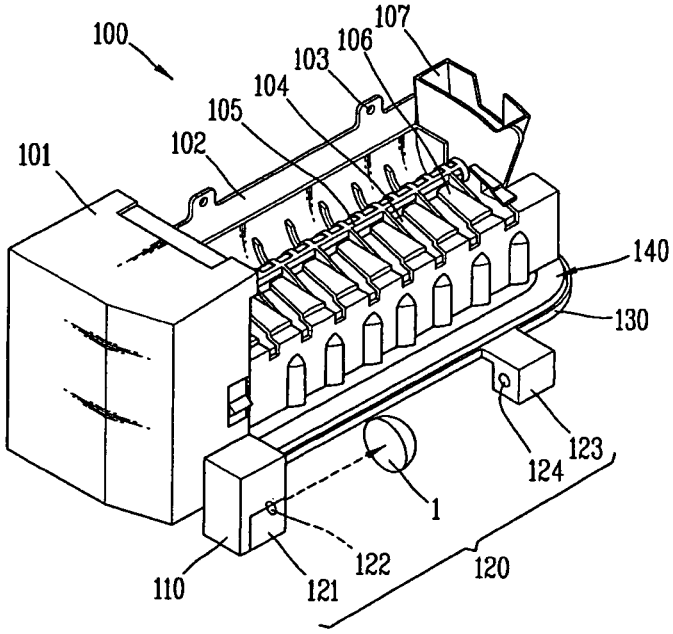
FIG. 6 is a perspective view showing that the ice detecting apparatus of the ice maker for the refrigerator detects an ice-full state according to the first embodiment.

FIG. 5 is a perspective view showing that the ice detecting apparatus of the ice maker for the refrigerator detects a state before full ice according to the first embodiment. FIG. 6 is a perspective view showing that the ice detecting apparatus of the ice maker for the refrigerator detects an ice-full state according to the first embodiment.

Ice made by the ice maker 100 is discharged and falls into the ice storage container 180. The fallen ice is collected and stored within the ice storage container 180. While the ice is collected in the ice container 180, and/or before the ice accommodating container 180 is full of ice, infrared rays transmitted from the transmitter 122 reach the receiver 124, and the controller determines whether the ice container 180 is full of ice based on signals received from or detected by the receiver. As ice is collected and stored, ice would reach the full or near full height of the ice container 180. Hence, as shown in FIG. 6, infrared rays transmitted from the transmitter 122 is interrupted by the ice, e.g., the optical path between the optical emitter and receiver is blocked, failing to reach the receiver 124, and the controller determines that the ice container 180 is full or near full of ice.

In this embodiment, the ice detecting sensor 120 is disposed at the ice maker body 101 and detects full or near full ice collected within the ice container 180. Because the ice detecting sensor 120 can detect a level of ice stored in the ice container 180, the related art problem(s) of a mechanical ice detecting lever (or the like) can be avoided. The ice filled state of the ice container 180 can be more accurately and stably detected.

Figure 7:
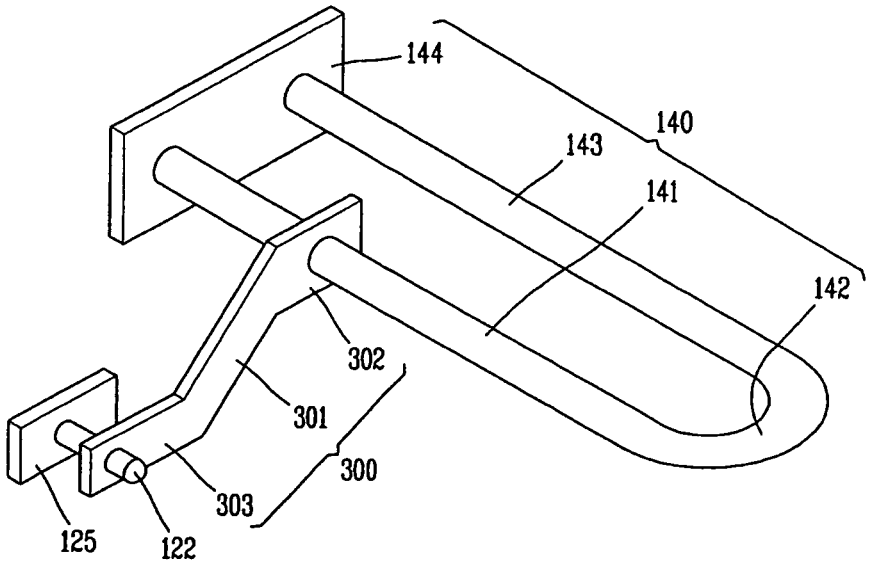
FIG. 7 is a perspective view of the ice detecting apparatus.
Figure 8:
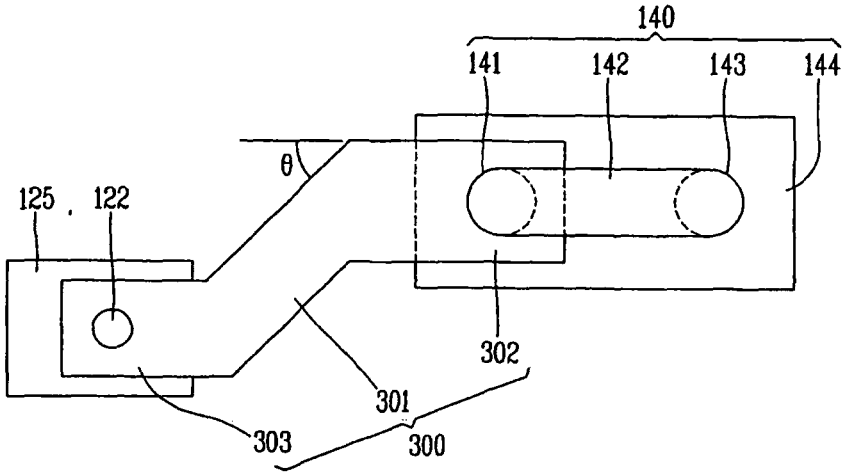
FIG. 8 is a side view schematically showing a portion of the configuration of the ice-full state detecting apparatus of the ice maker for the refrigerator according to the second embodiment.

FIG. 7 is a perspective view schematically showing a portion of the configuration of an ice detecting apparatus of the ice maker for the refrigerator according to the second embodiment, and FIG. 8 is a side view schematically showing a portion of the configuration of the ice-full state detecting apparatus of the ice maker for the refrigerator according to the second embodiment of the present invention. Hereinafter, any contents and explanations that have already been made for the first embodiment or is readily apparent to one of ordinary skill in the art based on the present disclosure will be omitted for the sake of brevity.

With reference to FIGS. 7 and 8, a heat bridge 300 is attached to the heater 140 of the ice maker 100 for transferring heat to the ice detecting sensor 120. The heat bridge 300 is shown to be connected with the transmitter 122 (alternatively, the transmitter module) of the ice-full detecting sensor 120, but of course, another heat bridge 300 may be connected with the receiver 124 (alternatively, the receiver module) of the ice detecting sensor 120 in the same or similar manner.

The heater 140 may include linear portions or rods 141 and 143 and a bent/curved portion or rod 142 and a connection plate 144 connecting or integrated with the linear portions 141 and 143. The heat bridge 300 has a step like shape and includes a connection/inclined portion or plate 301, a heater connection portion or plate 302 and a transmitter connection portion or plate 303.

The heater connection plate 302 allows heat at the linear portion 141 to pass therethrough, and surrounds the linear portion 141. The transmitter connection plate 303 allows transfer of heat to the transmitter 122 and surrounds the transmitter 122. The inclined plate 301 connects the heater connection plate 302 and the transmitter connection plate 303. The angle of inclination θ of the inclined plate may be varied depending upon h desired as shown in FIG. 4. The heat bridge 300 is made of a heat transmission material, e.g., a metal material. As can be appreciated, the thermal conductivity of the materials for the heater 140 and the heat bridge may be the same or different.

Heat generated by the heater 140 can be partially transferred to the transmitter 122 via the heat bridge 300. The surface of the transmitter 122 can be heated by heat delivered from the heater 140, defrosting or preventing frost from forming on the surface of the transmitter 122 and/or receiver 124 (alternatively, transmitter module and/or receiver module). As can be appreciated, the formation of frost on the transmitter 122 and/or receiver 124 hampers the transmission and/or detection of light from the transmitter or the receiver. The heater 140 may be continuously heated while the ice maker 100 is making and discharging ice, and the heat of the heater 140 can be continuously transferred to the ice detecting sensor 120 via the heat bridge 300.

When the ice detecting sensor 120 detects that the interior of the ice container 180 is full or near full of ice, the ice maker 100 stops making and discharging ice, and the operation of the heater 140 may be also stopped. In such an instance, there is a possibility that the receiver and transmitter of the ice detecting sensor 120 may become frosted. In order to defrost the surface of the receiver and transmitter, the controller may operate the heater 140 at certain time intervals to transfer heat to the ice detecting sensor 120 via the heat bridge 300. Accordingly, the ice-full state detecting sensor 140 may be defrosted while minimizing energy consumption by the heater 140, thus preventing degradation of a detecting capability of the ice detecting sensor 120.

Figure 9:
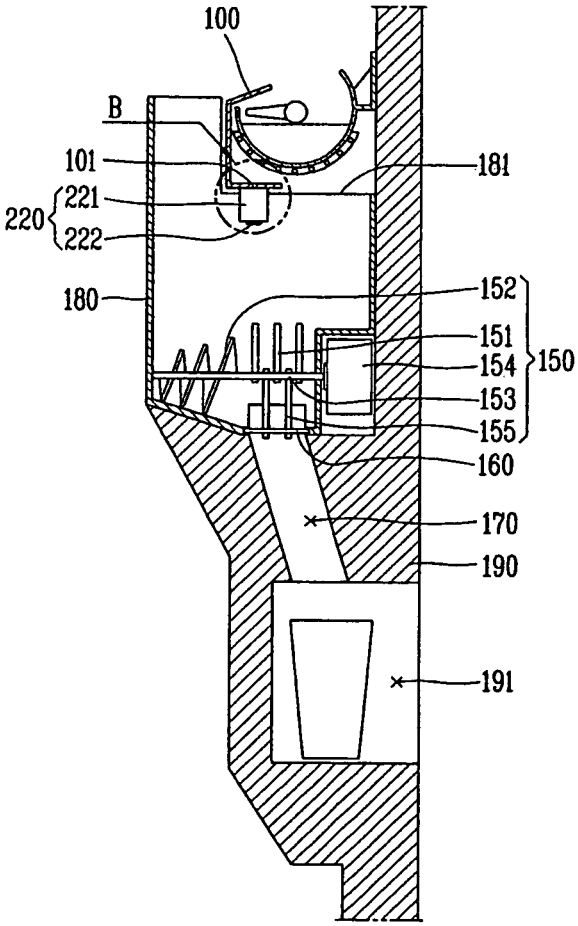
FIG. 9 is a schematic vertical sectional view showing a refrigerator ice maker employing an ice detecting apparatus according to a third embodiment.
Figure 10:
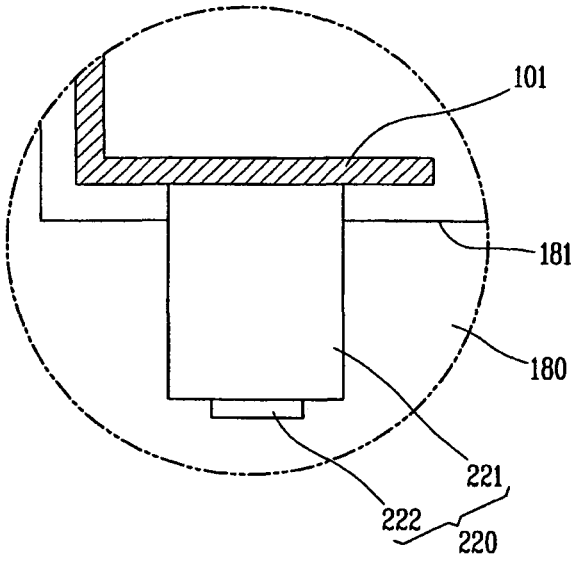
FIG. 10 is an enlarged view showing a portion 'B' in FIG. 9.

FIG. 9 is a schematic vertical sectional view showing a refrigerator ice maker employing an ice detecting apparatus according to a third embodiment, and FIG. 10 is an enlarged view showing a portion 'B' in FIG. 9. An ice detecting sensor 220 includes a transmitting unit 221 (oriented vertically) extending to allow a transmitter 222 to be positioned at or near the height of an ice-full state within the ice storage container 180. Although not shown, a receiving unit of the ice detecting sensor 220 may extend into the ice storage container 180 in the same or similar manner. The ice detecting sensor 220 can detect the distance between the ice maker body 101, and the ice cubes collected in the ice storage container 180, thereby recognizing whether the ice storage container 180 is full of ice.

Further, if the ice storage container 180 is released or removed, the distance detected by the ice detecting sensor 220 would be detected to be farther than the distance detected when the ice storage container 180 is installed. Thus, whether or not the ice storage container 180 is detached may be also detected according to a change in the detected distance. If the ice storage container 180 is detected to have been released, discharging ice from the ice maker 100 is also stopped to prevent ice from pouring down onto the floor of the refrigerator or kitchen.

Figure 11:
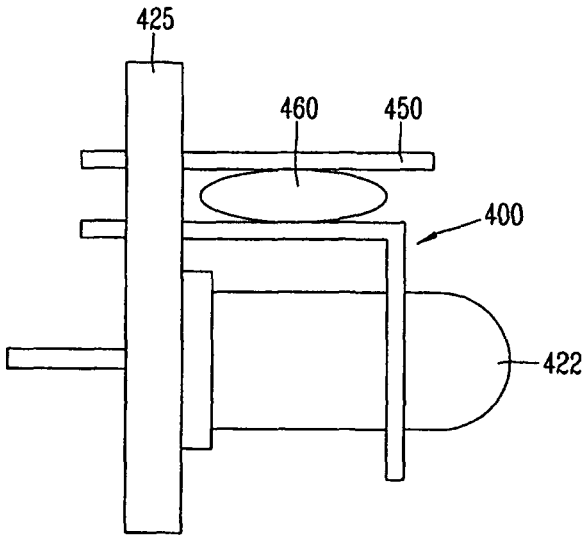
FIG. 11 is a side view showing a combined portion in the configuration of the ice detecting apparatus of an ice maker for a refrigerator according to a fourth embodiment.
Figure 12:
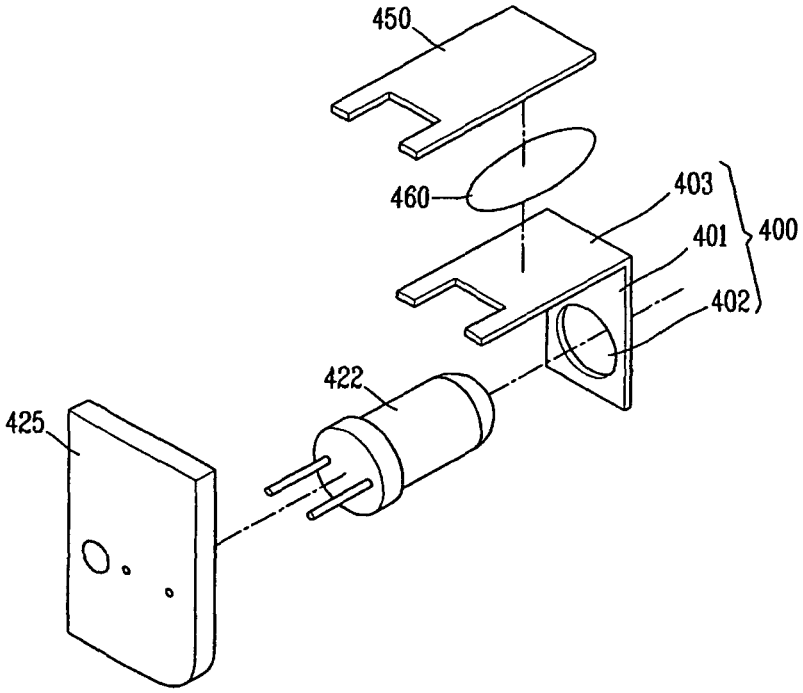
FIG. 12 is an exploded perspective view of the ice detecting apparatus in FIG. 11.

FIG. 11 is a side view showing a configuration of the transmitter and/or receiver according to a fourth embodiment, and FIG. 12 is an exploded perspective view of FIG. 11. A transmitter 422 is provided on a printed circuit board (PCB) 425, and a plate heater 450 is attached to the transmitter 422 such that the plate heater 450 can transfer heat via a heat bridge 400. Here, description for the transmitter 422 is provided, but the description is readily applicable to the receiver in the same or similar manner.

The plate heater 450 is made of a material that can generate heat when power or current is applied thereto, and has a plate form with a predefined (prescribed) thickness. Alternatively, the plate heater may be a resistive element/heater or resistor. One end of the plate heater 450 may be electrically coupled to the PCB 425. The heat bridge 400 includes a connection plate or portion 403 coupled to the PCB 425 and a bent plate or portion 401 bent downwardly, namely, toward the transmitter 422 from the connection plate 403. The heat bridge 400 with such configuration transfers heat generated from the plate heater 450 to the transmitter 422.

The bent plate 401 includes a hole or an opening 402 allowing the transmitter 422 to pass therethrough. The diameter of the transmitter is substantially the same as an outer diameter as that of the transmitter 422, so that when the transmitter 422 is inserted into the hole 402, an outer circumferential surface of the transmitter 422 and an inner circumferential surface of the hole 402 are substantially in contact or near contact with each other to allow transmission of heat to the transmitter 422 via the heat bridge 400 after being generated from the plate heater 450.

A thermal grease 460 may be provided between the plate heater 450 and the connection plate 403 of the heat bridge 400 if a gap exists therebetween to allow the plate heater 450 and the heat bridge 400 to be thermally coupled with each other. The thermal grease or dielectric should have relatively good thermal conductivity. Accordingly, the efficiency of transmission of heat to the heat bridge 400 via the thermal grease 460 after being generated from the plate heater 450 may be improved.

Because the plate heater 450 and the heat bridge 400 are provided, formation of frost can be prevented on the transmitter and/or receiver. In an alternative embodiment, the surface of the ice detecting sensor can be defrosted. The device prevents frost or moisture formation or defrosting operation can be simplified.

Figure 13:
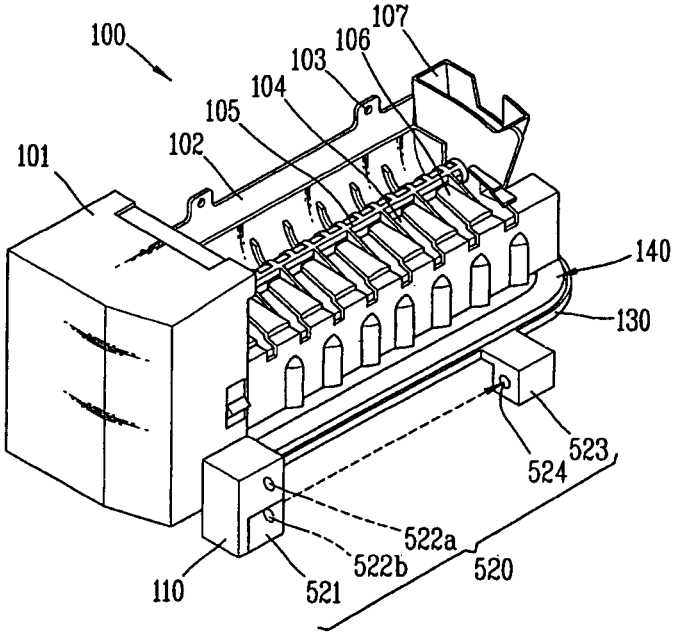
FIG. 13 is a perspective view showing that the ice detecting apparatus of the ice maker for the refrigerator detects a state before full ice according to a fifth embodiment.
Figure 14:
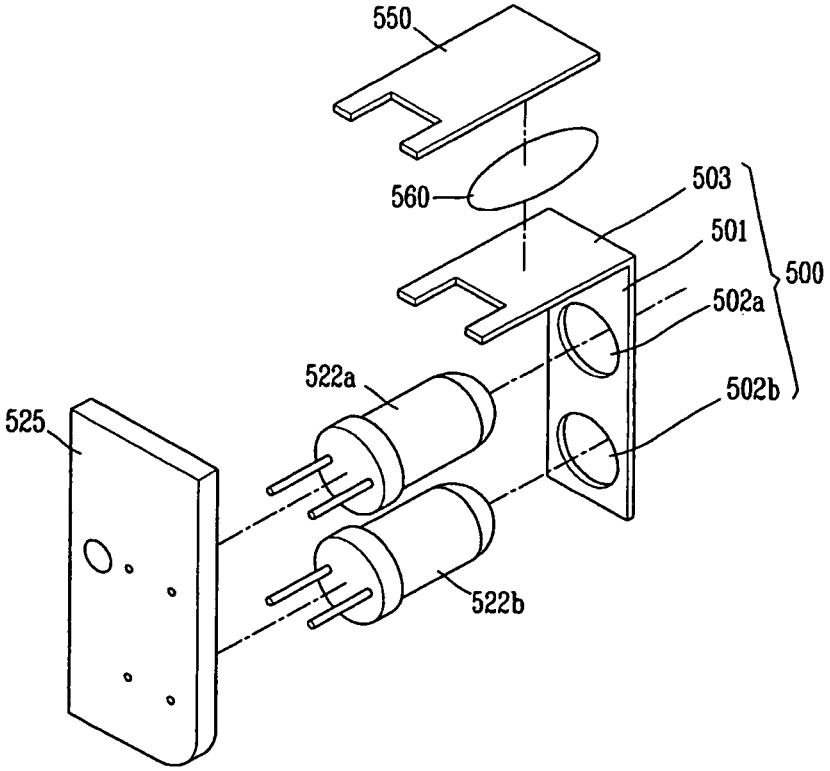
FIG. 14 is an exploded perspective view of the ice detecting apparatus in FIG. 13.
Figure 15:
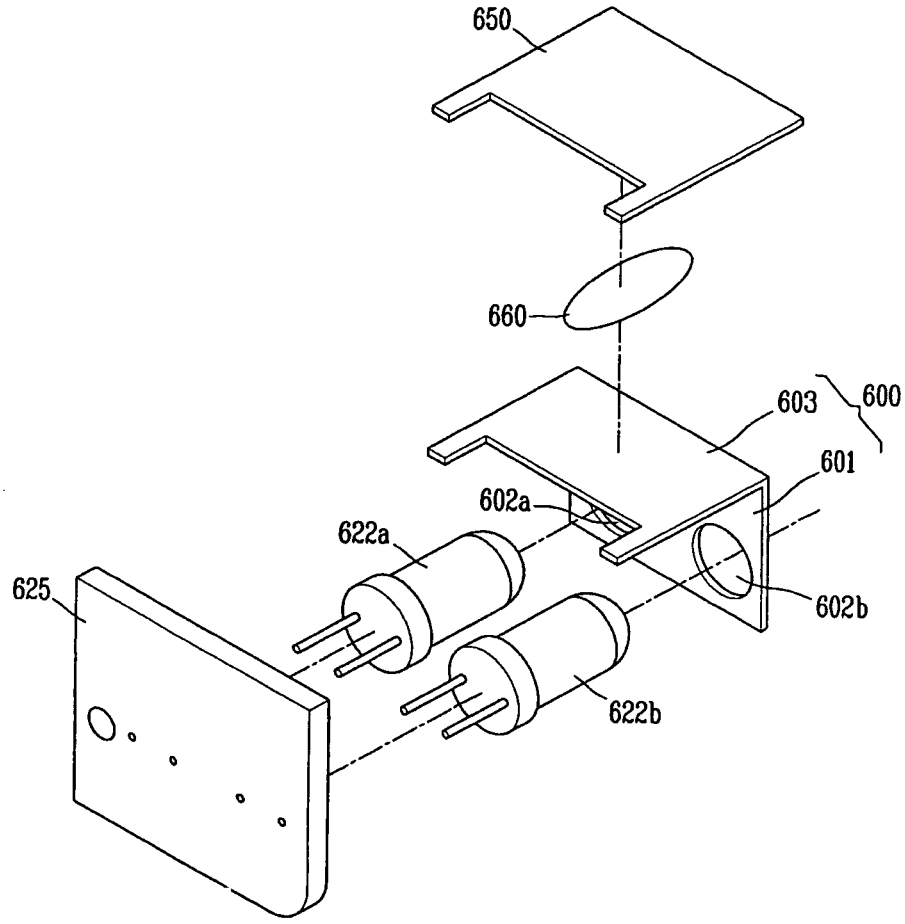
FIG. 15 is an exploded perspective view of an ice detecting apparatus according to a sixth embodiment.

FIG. 13 is a perspective view of the ice detecting apparatus of the ice maker for the refrigerator according to a fifth embodiment, and FIG. 14 is an exploded perspective view of the transmitter and/or receiver shown in FIG. 13. FIG. 15 is an exploded perspective view of the transmitter and/or receiver in an alternative arrangement according to a sixth embodiment of the present invention. A transmitting unit or transmitter module 521 of an ice-full state detecting apparatus includes a plurality of transmitters. For sake of explanation, two transmitters are shown. As can be appreciated, a plurality of receivers may be used or a single receiver may be used.

The two transmitters are disposed in a vertical direction relative to each other, e.g., in the direction of the ice storage container 180 at the ice maker 100, and FIG. 15 shows two transmitters disposed in a horizontal direction, namely, in a horizontal direction of the ice maker 100. As can be appreciated, each transmitter may be also located diagonally from each other.

With reference to FIG. 14, the transmitters 522*a* and 522*b* are coupled to a PCB 525, in the vertical direction, and a plate heater 550 is connected with the transmitters 522*a* and 522*b* such that it can transfer heat via the heat bridge 500. The plate heater 550 is made of a material that can generate heat when power is applied thereto, and has a plate form with a predefined prescribed) thickness. One end of the plate heater 550 is located with the PCB 525 and may be electrically connected with the PCB 525. As can be appreciated, there are common features of this embodiment to the FIG. 14 embodiment, and detailed description is omitted but is applicable to this embodiment The heat bridge 500 includes a connection plate or portion 503 coupled to the PCB 525 and a bent plate or portion 501 bent downwardly, namely, toward the transmitters 522*a* and 522*b* from the connection plate 503. The heat bridge 500 with such configuration allows transfer of heat generated from the plate heater 550 to the transmitters 522*a* and 522*b*.

The bent plate 501 includes holes or openings 502*a* and 502*b* allowing the transmitters 522*a* and 522*b* to pass therethrough. The diameters of the transmitters 522*a* and 522*b* are substantially the same as the diameters of the holes 502*a* and 502*b*. When the transmitters 522*a* and 522*b* are inserted into the holes 502*a* and 502*b*, outer circumferential surfaces of the transmitters 522*a* and 522*b* and inner circumferential surfaces of the holes 502*a* and 502*b* are in contact or near contact with each other.

A thermal grease or dielectric 560 is provided between the plate heater 550 and the connection plate 503 of the heat bridge 500, if to allow the plate heater 550 and the heat bridge 500 to be thermally coupled with each other. Accordingly, the efficiency of transmission of heat to the heat bridge 500 via the thermal grease 560 after being generated from the plate heater 550 can be improved. Because the plate heater 550 and the heat bridge 500 are provided, the formation of frost can be prevented. In an alternative embodiment, the surface of the ice detecting sensor can be defrosted and the device for performing defrosting can be simplified.

With reference to the FIG. 15 embodiment, transmitters 622*a* and 622*b* are coupled to a PCB 625 in a horizontal direction, and a plate heater 650 is connected with the transmitters 622*a* and 622*b* such that it can transfer heat via the heat bridge 600. The heat bridge 600 includes a connection plate or portion 603 coupled to the PCB 625 and a bent plate or portion 601 bent downwardly, namely, toward the transmitter 622*a* and 622*b* from the connection plate 603.

The bent plate 601 includes holes or openings 602*a* and 602*b* to allow the transmitters 622*a* and 622*b* to pass therethrough. Other than the horizontal arrangement, the description of FIG. 14 applies.

As shown in FIGS. 13 to 15, when the two transmitters are disposed, because the transmission area is increased, the detection performance of the ice detecting apparatus may be improved. Of course, three or more transmitters may be disposed, and in this case, the transmission are may be further increased. In FIGS. 13 to 15, a single receiver is shown, but multiple receivers may be used.

Figure 16:
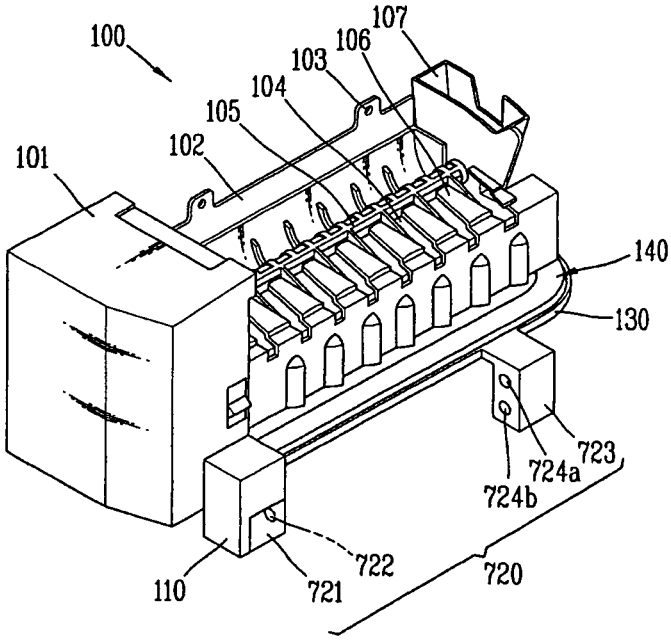
FIG. 16 is a perspective view showing that the ice detecting apparatus of the ice maker for the refrigerator detects a state before full ice according to a seventh embodiment.
Figure 17:
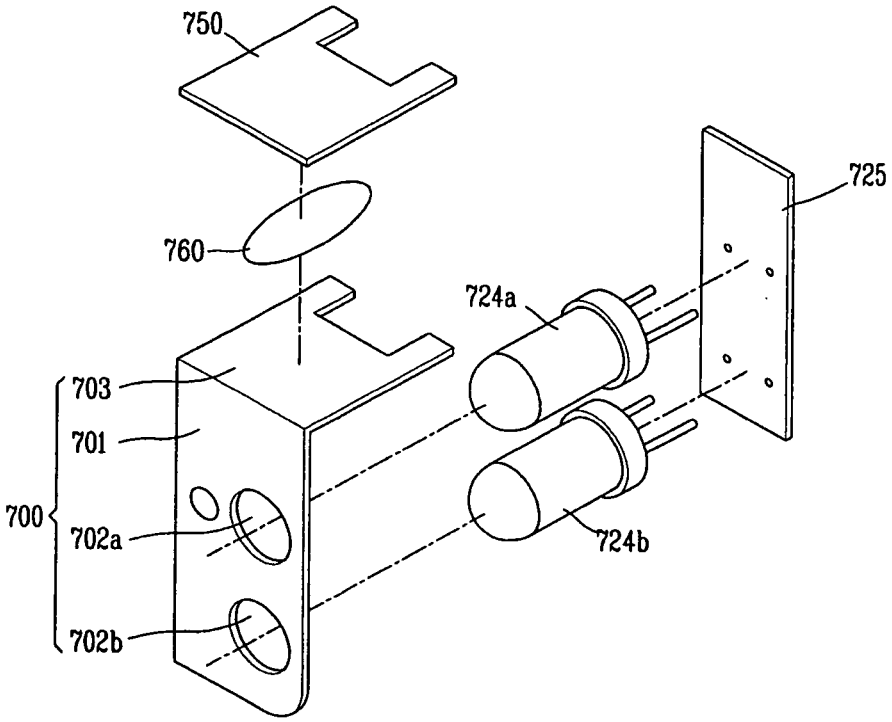
FIG. 17 is an exploded perspective view of the ice detecting apparatus in FIG. 16.
Figure 18:
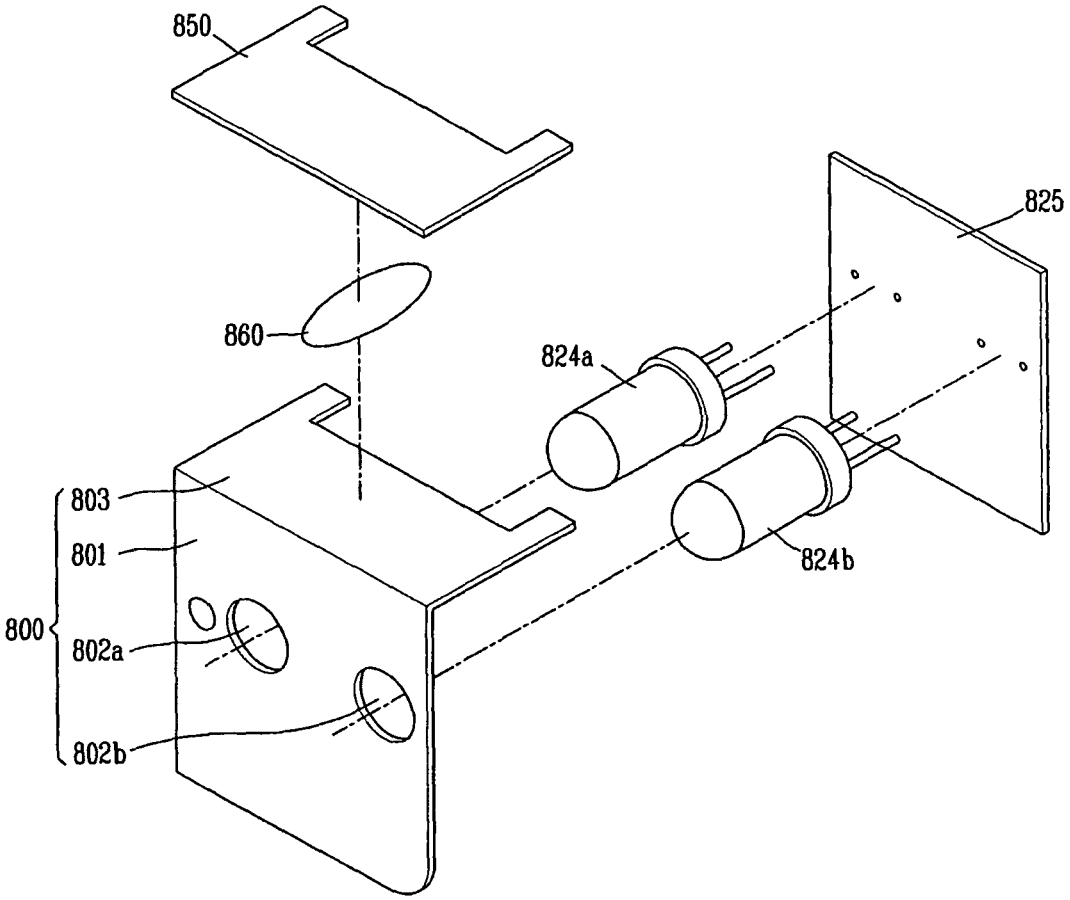
FIG. 18 is an exploded perspective view of an ice detecting apparatus according to an eighth embodiment.

FIG. 16 is a perspective view showing that the ice detecting apparatus of the ice maker for the refrigerator according to a seventh embodiment, and FIG. 17 is an exploded perspective view of the receiver in FIG. 16. FIG. 18 is an exploded perspective view of the receiver according to an eighth embodiment.

With reference to FIGS. 16 to 18, a receiving unit or a receiver module of an ice detecting apparatus includes a plurality of receivers. For explanation purposes the receiving unit is illustrated with two receivers. As can be appreciated the common description of the transmitter of above is readily applicable.

With reference to FIG. 17, the receivers 724*a* and 724*b* are coupled to a PCB 725 in a vertical direction, and a plate heater 750 is connected with the receivers 724*a* and 724*b* such that it can transfer heat via the heat bridge 700. The heat bridge 700 includes a connection plate or portion 703 coupled to the PCB 725 and a bent plate or portion 701 bent downwardly, toward the receivers 724*a* and 724*b* from the connection plate 703. The bent plate 701 includes holes or openings 702*a* and 702*b* allowing the receivers 724*a* and 724*b* to pass therethrough. When the receivers 724*a* and 724*b* are provided in the vertical direction, they can detect to which degree ice is full as well as an ice-full state upon detecting a signal transmitted from the transmitter. For example, if the receiver 724*b* does not detect a signal while the receiver 724*a* detects a signal, it can be determined that ice is filled up to the height of the receiver 724*b*.

With reference to FIG. 18, receivers 824*a* and 824*b* are coupled to a PCB 825, in a horizontal direction, and a plate heater 850 is connected with the receivers 824*a* and 824*b* such that it can transfer heat via a heat bridge 800. The heat bridge 800 includes a connection plate or portion 803 coupled to the PCB 825 and a bent plate or portion 801 bent downwardly, toward the receivers 824*a* and 824*b* from the connection plate 803. The bent plate 801 includes holes or openings 802*a* and 802*b* allowing the receivers 824*a* and 824*b* to pass therethrough.

When the receivers 824*a* and 824*b* are provided in the horizontal direction, they can detect whether there is an error in detecting whether or not ice is completely full as well as an ice-full state upon detecting a signal transmitted from the transmitter. For example, if the receiver 824*b* has received a signal transmitted from the transmitter while the receiver 824*a* has not, an error regarding an ice-full state can be detected based on the signal received or detected by the receiver 824*b*. In FIG. 16, a single transmitter is shown, but as described above, multiple transmitters are readily applicable.

Figure 19:
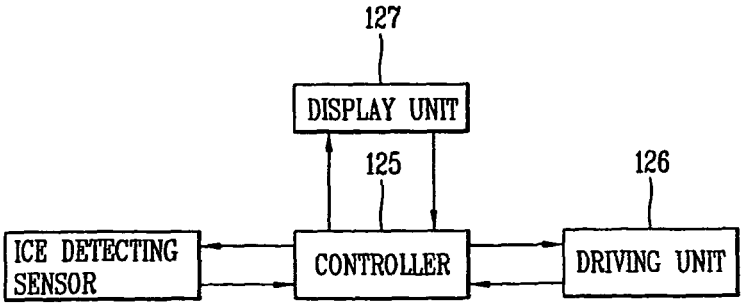
FIG. 19 is a schematic block diagram showing elements of the ice detecting apparatus of the ice maker for the refrigerator.

FIG. 19 is a schematic block diagram showing elements of the ice detecting apparatus of the ice maker for the refrigerator. A signal detected by the ice detecting sensor (previously described in any one of the embodiments) is transferred to a controller 125. The controller 125 processes the signal and issues a command to a driving unit 126. Upon receiving the command, the driving unit 126 drives each element of the refrigerator. A processed state of the controller 125 may be displayed on a display unit 127.

Figure 20:
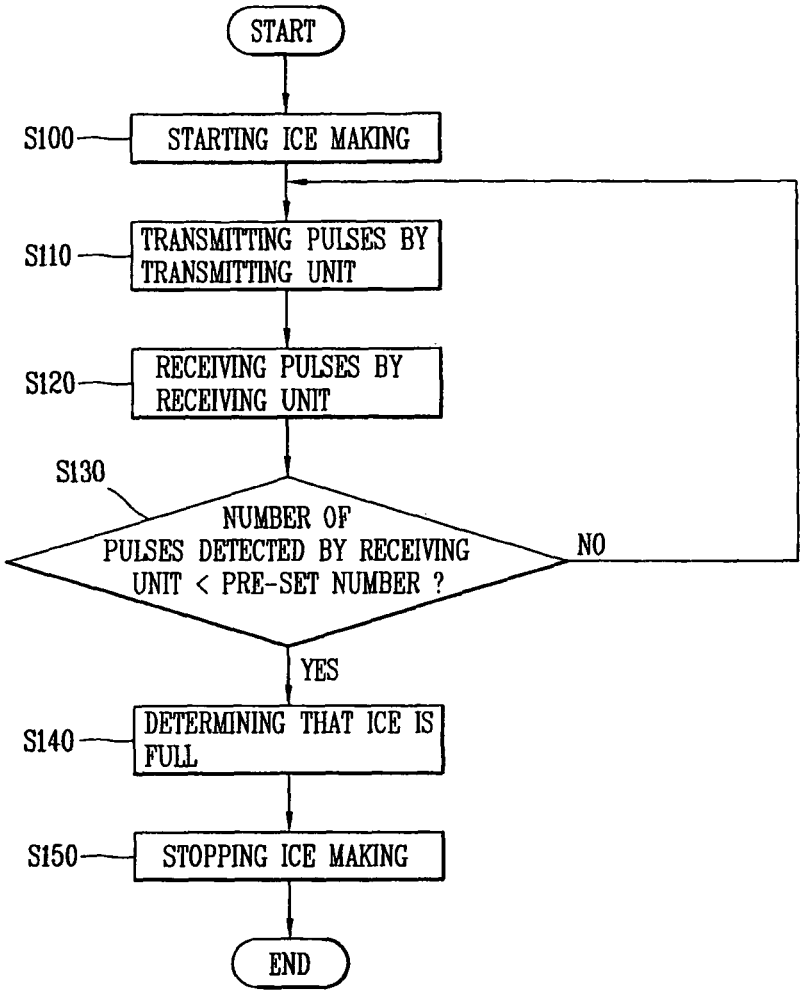
FIG. 20 is a flow chart illustrating an ice detecting method of an ice maker for a refrigerator according to a first embodiment.

FIG. 20 is a flow chart illustrating an ice detecting method of an ice maker for a refrigerator according to a first embodiment. The configuration of the ice detecting apparatus of the ice maker for a refrigerator will be described with reference to elements labeled in FIGS. 1 to 6 and 19 for simplicity. As appreciated, this method is applicable to any one or all embodiments in a same or similar manner previously described.

With reference to FIG. 20, ice making starts (S100), and the transmitter 122 of the transmitting unit 121 transmits optical pulses of prescribed intensity and duration (S110). The transmitted pulses are received by the receiving unit 123 (S120), and the received pulse information, which are converted to electrical signals based on detected pulse signals from the transmitter, is transferred to the controller 125. Upon receiving the pulse information, the controller 125 checks whether the number of pulses detected by the receiving unit 123 is smaller than a pre-set pulse number (S130).

If the number of the detected pulses is smaller than the pre-set pulse number, the controller 125 determines that a portion or the entirety of the pulses transmitted by the transmitting unit 121 have not been received by the receiving unit 123, because they were blocked by ice filled up in the ice storage container 180. Namely, the controller 125 determines that the ice accommodating container 180 may be full or nearly full of ice (S140).

If, however, the number of pulses detected by the receiving unit 123 is the same as or larger than the pre-set pulse number, the controller 200 determines that the ice accommodating container 180 is not yet full of ice, ice making continue, and keeps detecting of pulses (S110, S120).

Figure 21:
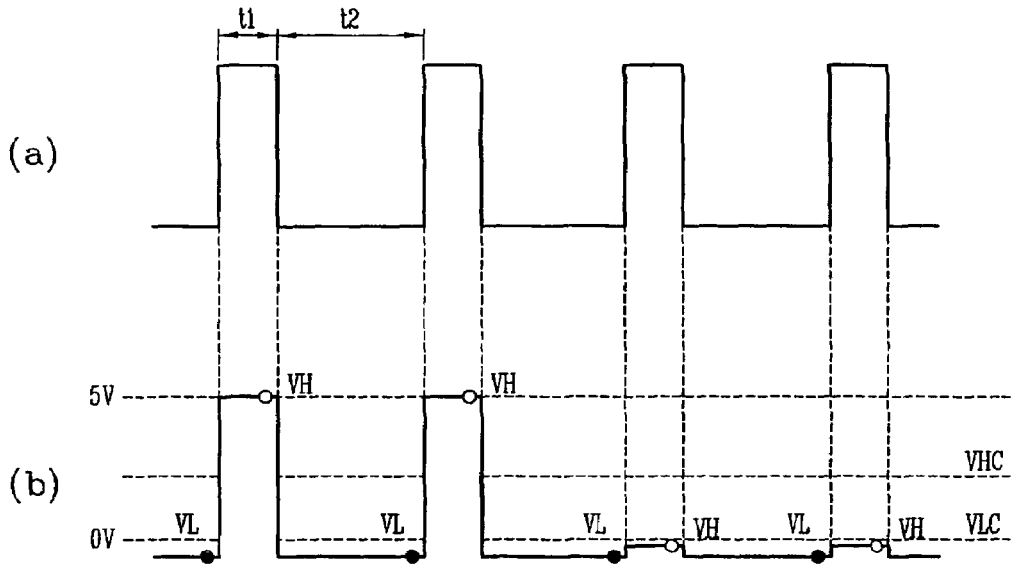
FIG. 21 shows waveforms of signals transmitted and received according to the ice detecting method of an ice maker for a refrigerator according to the first embodiment.

FIG. 21 shows waveforms of signals transmitted and received according to the ice detecting method of an ice maker for a refrigerator according to the first embodiment. As shown in (a), an optical signal transmitted from the transmitter 122 in transmitting unit 121 of the ice maker is an optical pulse of a prescribed intensity generated for a prescribed period of time t1. A plurality of the pulses may be continuously transmitted at certain time intervals t2.

If the ice storage container 180 is not full of ice, the transmitted pulses are detected by the receiver 124 and converted to pulses of a voltage VH, e.g., 5V, higher than a certain threshold voltage level VHC by the receiving unit 123 as shown in (b).

If the ice accommodating container 180 is full of ice, the transmitted pulses are received as pulses of a certain voltage VL, e.g., about 0V, lower than a threshold voltage VLC by the receiving unit 123 as shown in (b).

If pulses of more than certain number, among the plurality of pulses transmitted by the transmitting unit 121, are detected by the receiving unit 123, it is determined that the ice storage container is not full of ice, whereas if pulses of less than certain number are detected, it is determined that the ice storage container is full of ice.

In other words, the voltage of the pulses detected by the receiving unit 123 is higher than a first threshold voltage, e.g., VHC, which is lower by a pre-set voltage than the voltage of the pulses detected by the receiving unit 123, it is determined that the receiving unit 123 has received the transmitted pulses. If the voltage of the received pulses is lower than a second threshold voltage, e.g., VLC, of a pre-set certain size, it is determined that the receiving unit 123 has not received the transmitted pulses.

The number of pre-set pulses based on which the ice-full state is determined may be at least one. Namely, if the receiving unit 123 detects at least one pulse, it is determined that the ice accommodating container is not full of ice, whereas if none of pulses is detected, it is determined that the ice accommodating container is full of ice. Many variations are possible, based on this disclosure. For example, if four optical pulses are sent, one or less pulses detected may indicate full or nearly full, whereas, three or more pulses detected may indicate not full or not nearly full. If two pulses are detected, the controller may interpret such detection of pulses to require self-diagnostic for system error, turn on the heater, etc.

Figure 22:
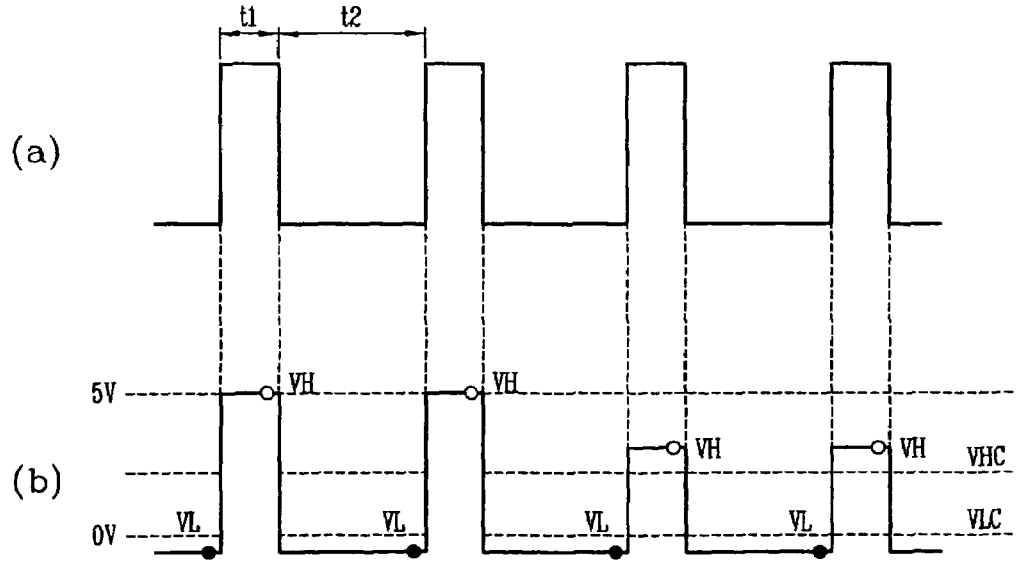
FIG. 22 shows waveforms of signals transmitted and received according to the ice detecting method of an ice maker for a refrigerator according to a second embodiment.

FIG. 22 shows waveforms of signals transmitted and received according to the ice detecting method of an ice maker for a refrigerator according to a second embodiment. The configuration of the ice detecting apparatus of the ice maker for a refrigerator will be described with reference to elements labeled in FIGS. 1 to 6 and 19 for simplicity of description. As appreciated, this method is applicable to any one or all embodiments in a same or similar manner previously described.

As shown in (a), an optical signal transmitted by the transmitter 122 of the transmitting unit 121 has a pulse form of a certain intensity generated during a certain time period t1. A plurality of the pulses may be continuously transmitted at certain time intervals t2.

Whether or not ice is full can be determined according to whether or not the transmitted pulses are detected by the receiver 124 of the receiving unit 123. In this respect, the voltage value of the pulses detected by the receiving unit 123 may differ depending on the presence of moisture or frost of more than a certain amount near the ice detecting sensor 120, so whether or not ice is full may be determined in consideration of the presence of such moisture or frost.

For example, if the voltage value of the transmitted pulses is 5V, the pulses of substantially 5V would be detected by the receiving unit 123 without moisture, but with moisture or frost, pulses of voltage lower than 5V would be detected by the receiving unit 123. The fact that pulses are detected by the receiving unit 123 means that the ice storage container is not full of ice, so detection of pulses with a voltage lower than 5V should be determined as pulse detection.

As shown in (b), if the voltage value of the pulses detected by the receiving unit 123 is higher than the certain voltage value VHC which is lower than the voltage value transmitted by the transmitting unit 121, it is detected as pulse reception, thereby enabling detection whether or not ice is full even with moisture or frost.

Figure 23:
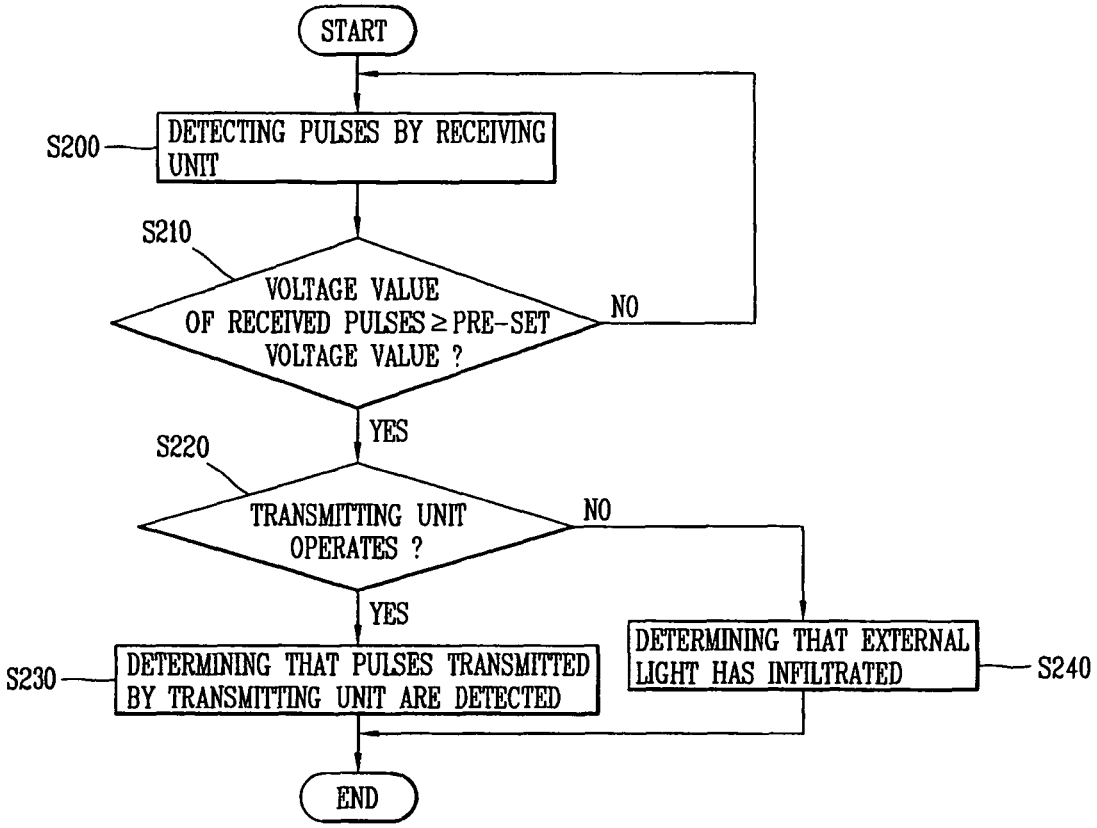
FIG. 23 is a flow chart illustrating an ice detecting method of an ice maker for a refrigerator according to a third embodiment.

FIG. 23 is a flow chart illustrating an ice-full state detecting method of an ice maker for a refrigerator according to a third embodiment. The configuration of the ice detecting apparatus of the ice maker for a refrigerator will be described with reference to elements labeled in FIGS. 1 to 6 and 19 for simplicity of description. As appreciated, this method is applicable to any one or all embodiments in a same or similar manner previously described.

When the receiving unit 123 detects pulses (S200) via receiver 124, it is determined whether a voltage value of the received pulses is higher than a pre-set voltage value (S210). If the voltage value of the received pulses is determined to be higher than the pre-set voltage value, it is determined whether or not the transmitting unit 121 was in operation, i.e., whether or not there were pulses transmitted by the transmitting unit 121 (S220).

If it is determined that the transmitting unit 121 sent the pulses, it may be determined that the pulses transmitted by the transmitting unit 121 are detected by the receiving unit 123, and accordingly a determination may be made as to whether or not ice is full or nearly full.

If it is determined that the transmitting unit 121 did not send the pulses, it is determined that external light may have been received by the receiving unit 123 (S240), and an operation such as stopping of ice making may be performed to prevent ice from spilling down, especially if the external light is caused by opening of the door. With such a configuration, even when external light infiltrates into the freezing chamber, the ice-full state detecting apparatus 120 can accurately perform detection and ice pouring can be prevented.

Figure 24:
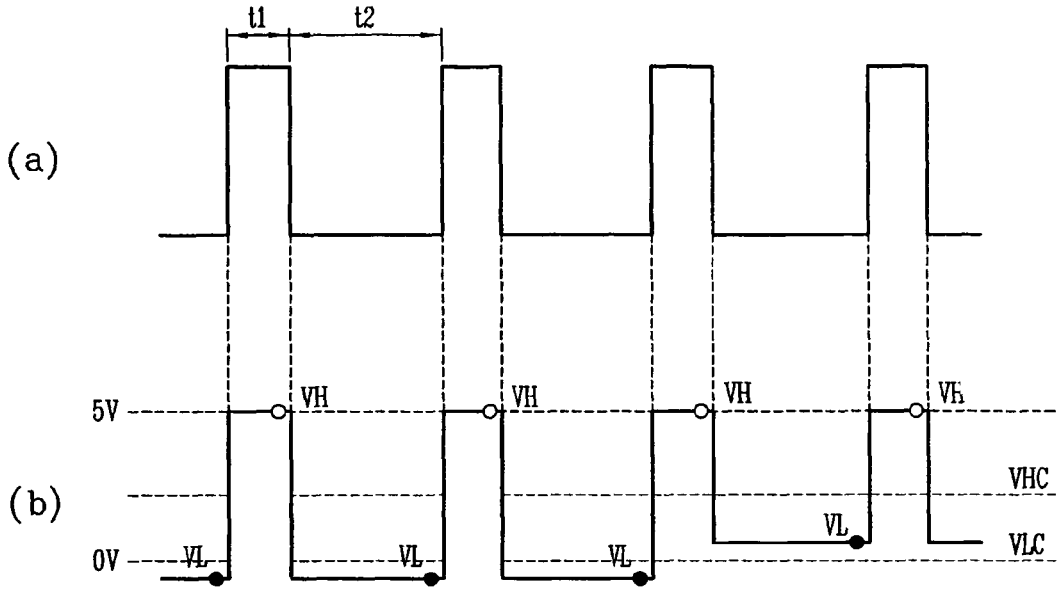
FIG. 24 shows waveforms of signals transmitted and received according to the ice detecting method of an ice maker for a refrigerator according to the third embodiment.

FIG. 24 shows waveforms of signals transmitted and received according to the ice detecting method of an ice maker for a refrigerator according to the third embodiment. As shown in (b), when pulses are received by the receiver 124 of the receiving unit 123 without external light, because they are detected as those which have been transmitted by the transmitting unit 121, a determination can be made as to whether or not ice is full or nearly full. As shown in (b), if pulses are received by the receiving unit 123 although the transmitting unit 121 has not transmitted pulses, it is determined that external light has infiltrated, so operation such as stopping of ice making or the like may be performed.

Figure 25:
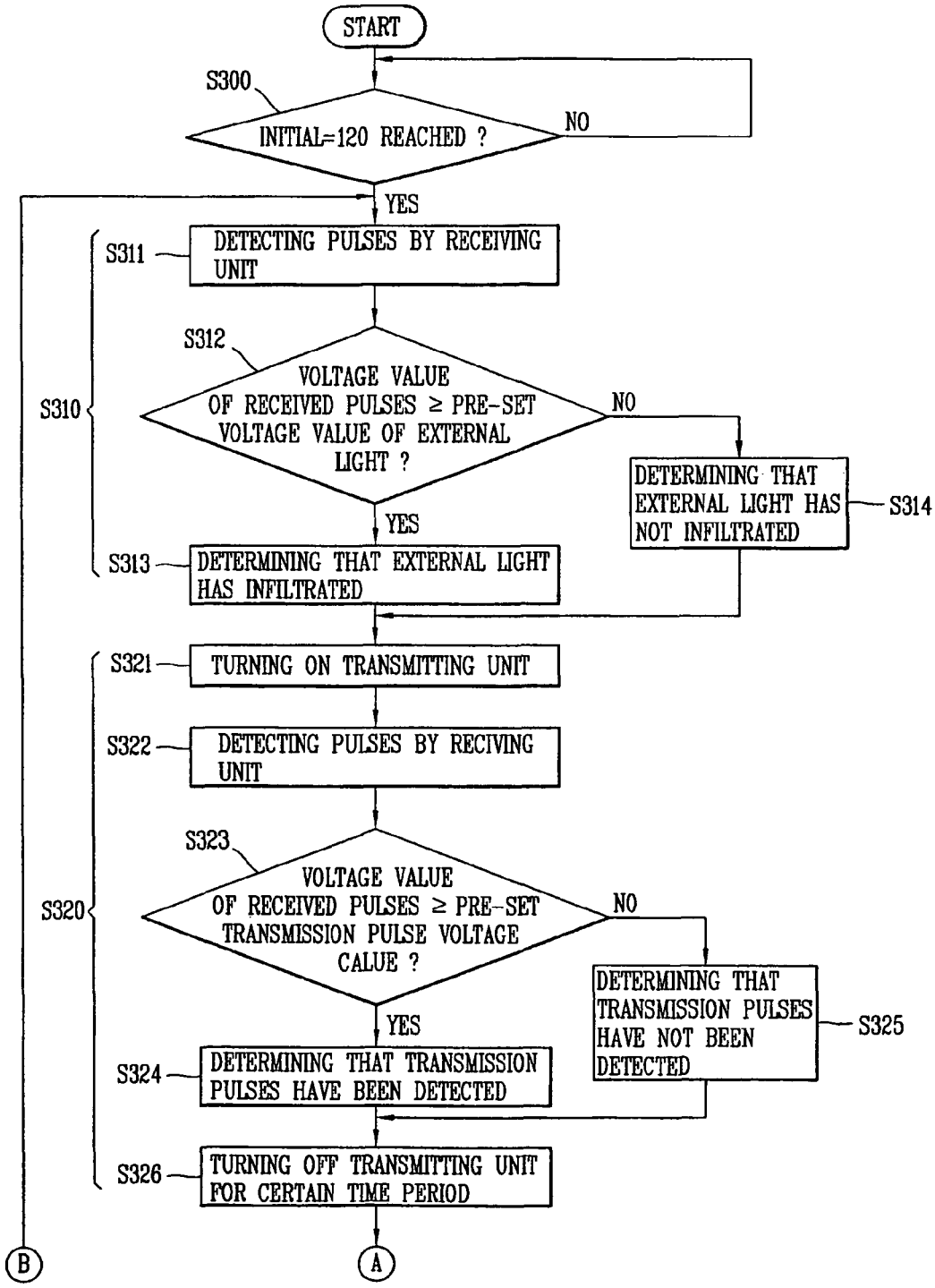
FIGS. 25 and 26 are flow charts illustrating an ice-full state detecting method of an ice maker for a refrigerator according to a fourth embodiment of the present invention.
Figure 26:
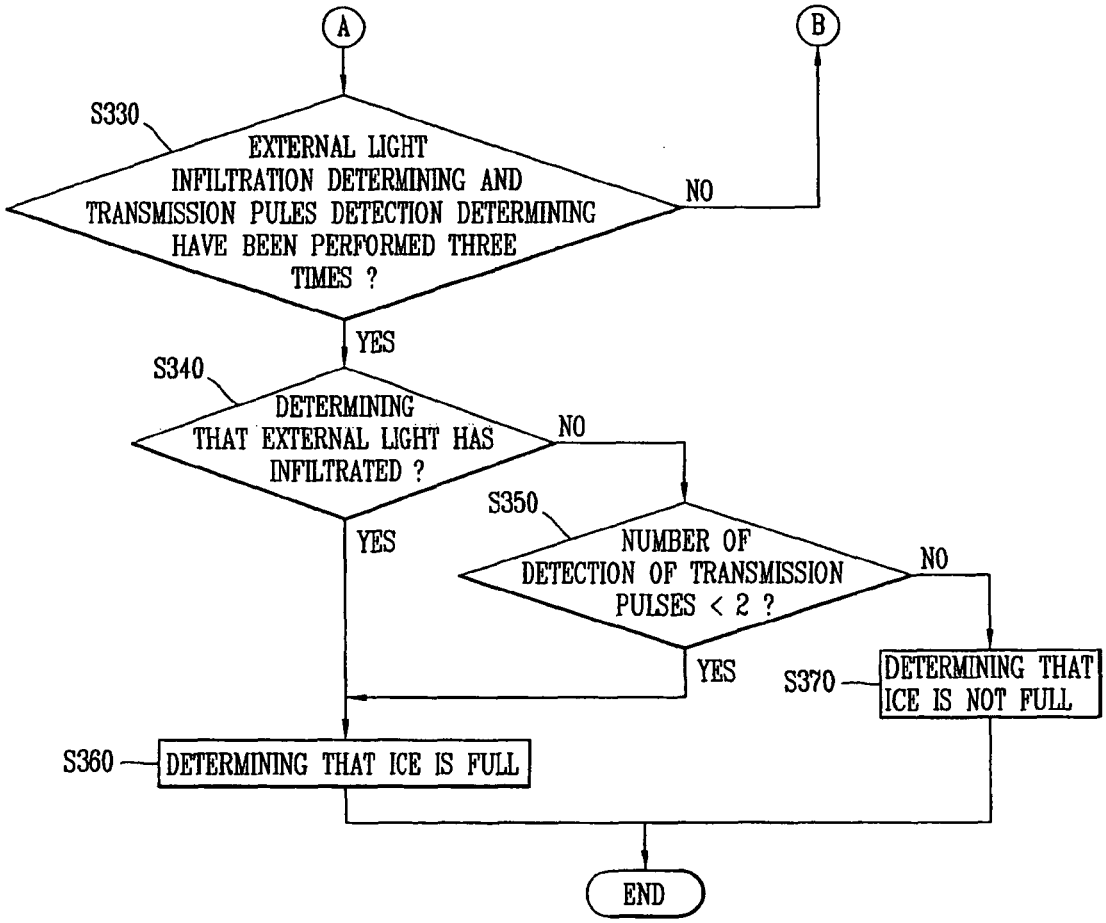

FIGS. 25 and 26 are flow charts illustrating an ice detecting method of an ice maker for a refrigerator according to a fourth embodiment. The configuration of the ice detecting apparatus of the ice maker for a refrigerator will be described with reference to elements labeled in FIGS. 1 to 6 and 19 for simplicity of description. As appreciated, this method is applicable to any one or all embodiments in a same or similar manner previously described.

It is determined whether or not an initial time has reached a prescribed time period, e.g., 120 seconds, (S300). Such determining as to whether or not the initial time has lapsed is to allow the ice maker to have time to be in an initial stage for ice making. Various other time periods may be used. By using seconds, the accuracy of measurement may be improved and a life span of the sensor may be lengthened.

If the initial time reaches 120 seconds, an external light infiltration determining step (S310) and a transmission pulse detection determining step (S320) are performed. The external light infiltration determining step (S310) and the transmission pulse detection determining step (S320) may be repeatedly performed certain number of times, e.g., three times. Each step will now be described in detail as follows.

In the external light infiltration or detection determining step S310, the receiving unit 123 detects pulses while the transmitting unit 121 is inactive (S311). It is determined whether a voltage value of the pulses received by the receiving unit 123 is higher than a pre-set external light voltage value (S312). The external light voltage value is a voltage value based on which the receiving unit 123 determines whether or not external light has been introduced, which can be determined to be smaller than a voltage value of the pulses transmitted by the transmitting unit 121. If the voltage value of the received pulses is determined to be the pre-set external light voltage value or higher, it is determined that external light has infiltrated or has been detected (S313). If, however, the voltage value of the received pulses is lower than the pre-set external light voltage value, it is determined that external light has not infiltrated or not detected (S314). Such detection is similar to the previous description.

At the start of the transmitted pulse detection determining step S320, the transmitting unit 121 is turned on (S321), and the receiving unit 123 detects pulses transmitted by the transmitting unit 121 (S322). It is determined whether a voltage value of the pulses received by the receiving unit 123 is a pre-set transmission pulse voltage value or higher (S323). As described previously, the transmission pulse voltage value is a voltage value based on which it is determined that the pulses transmitted by the transmitting unit 121 has been received by the receiving unit 123. If the voltage value of the received pulses is the pre-set transmission pulse voltage value or higher, it is determined that the pulses transmitted by the transmitting unit 121 have been detected (S324). If, however, the voltage value of the received pulses is lower than the pre-set transmission pulse voltage value, it is determined that the pulses transmitted by the transmitting unit 121 have not been detected (S325). After determining whether or not the transmission pulses have been detected, the transmitting unit 121 is turned off during a certain time, e.g., during one second (S326).

Thereafter, it is determined whether or not the external light infiltration determining step S310 and the transmission pulse detection determining step S320 have been performed by certain number of times, e.g., three times (S330). If the external light infiltration determining step S310 and the transmission pulse detection determining step S320 have been performed by not larger than three times, the external light infiltration determining step S310 and the transmission pulse detection determining step S320 are performed until it reaches three times.

When the external light infiltration determining step S310 and the transmission pulse detection determining step S320 have been performed three times, it is determined whether external light has infiltrated in the external light infiltration determining step S310 (S340). If it is determined that external light has infiltrated in step S340, it is determined that ice is full (S360) and the operation such as stopping of the ice maker or the like is performed.

If it is determined that external light has not infiltrated, it is determined whether or not the number of detection of transmission pulses is smaller than a certain number, e.g., two times (S350). If the number of detection of transmission pulses is smaller than two times, it is determined that ice is full (S360) and the operation such as stopping of the ice maker or the like is performed. If the number of detection of transmission pulses two times or larger, it is determined that ice is not full (S370) and the operation such as continuously performing ice making is performed.

With such a configuration, whether or not external light has infiltrated and whether or not pulses transmitted by the transmitting unit are detected can be determined, and thus, the operation of the ice maker can be more precisely performed. In addition, whether or not external light has infiltrated and whether or not pulses transmitted by the transmitting unit are detected are performed by more than certain number of times, the operation of the ice maker can be more accurately performed.

The ice detecting apparatus of the ice maker for a refrigerator may have certain advantages. Because the ice detecting sensor is disposed in the ice maker body to detect whether to detect whether or not the ice storage container is full of ice, a problem arising as a mechanical ice-full state detecting lever or the like for detecting whether or not ice is full is frozen so that it cannot properly perform detection can be avoided, and whether or not the ice accommodating container is full of ice can be accurately and stably detected. Because the detection height of the ice-full state detecting sensor corresponds to the height of ice-full state in the ice storage container with a certain height difference from an upper end of the ice storage container. Thus, whether or not the ice storage container is full of ice can be accurately detected by the ice detecting sensor.

If a voltage value of pulses detected by the receiving unit is higher than a certain value which is lower than the voltage value of the pulses transmitted by the transmitting unit, it is detected as a pulse reception, so whether or not ice is full can be more accurately detected even with moisture. If pulses are received by the receiving unit although the transmitting unit does not operate, it may be determined that external light has infiltrated into the receiving unit. Thus, without external light infiltrating, the ice detecting apparatus can accurately perform detection and ice flushing can be prevented.

This application is related to U.S. application Ser. Nos. 12/423,118, 12/423,170 and 12/423,256 all filed on Apr. 14, 2009, whose entire disclosures are incorporated herein by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice detecting apparatus for a refrigerator, comprising:
an ice maker;
a storage container to collect ice from the ice maker;
an ice detecting sensor provided at the ice maker, including a transmitting unit to transmit one or more pulses and a receiving unit to detect the pulses transmitted from the transmitting unit; and
a controller to determine whether the storage container is full or nearly full based on pulses detected by the receiving unit among the one or more pulses transmitted by the transmitting unit, wherein the controller determines whether or not external light has been introduced into the ice maker based on the pulses detected by the receiving unit.

2. The apparatus of claim 1, wherein the controller compares the number of received pulses with a pre-set number, and determines whether or not the storage container is full according to the comparison result.

3. The apparatus of claim 1, wherein if the difference between the voltage of the transmitted pulses and the voltage of the received pulses is larger than a pre-set first voltage, the controller determines that the receiving unit has received pulses.

4. The apparatus of claim 1, wherein if the voltage of the received pulses is lower than a pre-set second voltage, the controller determines that the receiving unit has not received pulses.

5. The apparatus of claim 1, wherein the transmitting unit comprises at least one optical emitter or at least one photo diode.

6. The apparatus of claim 1, wherein the receiving unit includes at least one optical receiver or at least one photo transistor.

7. An ice detecting apparatus for a refrigerator, comprising:
an ice maker;
a storage container to collect ice from the ice maker;
an ice detecting sensor provided at the ice maker, including a transmitting unit to transmit one or more pulses and a receiving unit to detect the pulses transmitted from the transmitting unit and
a controller to determine whether the storage container is full or nearly full based on pulses detected by the receiving unit among the one or more pulses transmitted by the transmitting unit, wherein if the receiving unit detects pulses before pulses are transmitted by the transmitting unit, the controller determines that external light has been introduced into the ice maker.

8. An ice detecting method of an ice maker for a refrigerator, comprising, detecting an ice-full state of ice transferred from the ice maker to a storage container based on whether or not an ice detecting sensor installed at the ice maker detects a prescribed number of pulses; and determining whether or not external light has been introduced into the ice maker based on the pulses detected by the ice detecting sensor.

9. The method of claim 8, further comprising:

transmitting pulses by a transmitting unit of the ice detecting sensor; and determining whether or not the storage container is full based on the pulses detected by a receiving unit of the ice detecting sensor, among one or more pulses transmitted by the transmitting unit.

10. The method of claim 9, wherein detecting pulses of a certain pre-set number or larger, is determined to indicate a non-full amount of ice.

11. The method of claim 10, wherein the certain pre-set number is one.

12. The method of claim 10, wherein the first voltage is higher than the second voltage.

13. The method of claim 9, wherein detecting pulses smaller than the certain pre-set number indicates full or nearly full amount of ice.

14. The method of claim 13, wherein the certain pre-set number is one.

15. The method of claim 9, wherein a difference between the voltage of the transmitted pulses and the received pulses being a pre-set first voltage or larger indicates that the receiving unit has received pulses, and if the voltage of the received pulses being lower than a pre-set second voltage indicates that the receiving unit has not received a pulse.

16. An ice detecting method of an ice maker for a refrigerator comprising:

determining whether a transmitting unit of an ice detecting sensor is inactive; and determining whether a receiving unit of the ice detecting sensor detects pulses although previous step indicates inactivity of the transmitting unit; and stopping an operation of the ice maker.

* * * * *